United States Patent [19]

Nubani et al.

[11] 4,398,897

[45] Aug. 16, 1983

[54] METHOD OF PROCESSING A CATHODE-RAY TUBE FOR ELIMINATING BLOCKED APERTURES CAUSED BY CHARGED PARTICLES

[75] Inventors: Jawdat I. Nubani, Clarks Summit; Frank S. Sawicki, Scranton, both of Pa.

[73] Assignee: RCA Corporation, New York, N.Y.

[21] Appl. No.: 287,569

[22] Filed: Jul. 28, 1981

[51] Int. Cl.[3] ..... F01J 9/20

[52] U.S. Cl. ..... 445/5; 445/6; 445/10; 445/11; 445/19

[58] Field of Search ..... 445/5, 6, 9, 10, 11, 445/14, 19, 21; 313/174

[56] References Cited

U.S. PATENT DOCUMENTS

| | | | |
|---|---|---|---|
| 3,131,983 | 5/1964 | Harries | 316/25 |
| 3,321,263 | 5/1967 | O'Fallon | 445/5 |
| 3,329,853 | 7/1967 | Neuhauser | 313/179 |
| 3,712,699 | 1/1973 | Syster | 316/2 |
| 3,792,300 | 2/1974 | Benda et al. | 313/85 R |
| 3,952,226 | 4/1976 | Turnbull | 313/174 X |
| 4,006,381 | 2/1977 | Thall | 313/481 |

FOREIGN PATENT DOCUMENTS

| | | |
|---|---|---|
| 682555 | 11/1952 | United Kingdom . |
| 682556 | 11/1952 | United Kingdom . |
| 1041356 | 9/1966 | United Kingdom . |
| 1142661 | 2/1969 | United Kingdom . |
| 1194357 | 6/1970 | United Kingdom . |
| 1476339 | 6/1977 | United Kingdom . |
| 1534169 | 11/1978 | United Kingdom . |

*Primary Examiner*—Kenneth J. Ramsey
*Attorney, Agent, or Firm*—Eugene M. Whitacre; Dennis H. Irlbeck; Vincent J. Coughlin, Jr.

[57] ABSTRACT

A method is proposed for eliminating so-called halo blocked apertures in color picture cathode-ray tubes. The cathode-ray tube comprises an evacuated envelope having therein a luminescent viewing screen, an electron gun for producing at least one electron beam for exciting the screen to luminescence and an apertured mask closely spaced from the screen for selectively intercepting and transmitting portions of the electron beam. A getter is provided for coating an interior surface of the apertured mask with a gas-sorbing, conductive getter material film. The halo blocked apertures are caused by insulative negatively-charged particles attached to the interior surface of the apertured mask. The conventional tube processing includes the steps of getter flashing, cathode discharge ball gap, cathode conversion, hot shot, first low voltage age, implosion proofing, external coating, frit breakdown check, radio frequency spot knock and final low voltage age. The improved method comprises controlling the getter flashing step so that the getter yields a primary film having about 50 to 75 percent of the available getter material. The getter is reactivated subsequent to the frit breakdown check step and before the final low voltage age step to provide a secondary film of getter material on the interior surface of the mask which will render conductive the insulative particles attached to the interior surface of the apertured mask.

7 Claims, 2 Drawing Figures

METHOD OF PROCESSING A CATHODE-RAY TUBE FOR ELIMINATING BLOCKED APERTURES CAUSED BY CHARGED PARTICLES

BACKGROUND OF THE INVENTION

This invention relates to a novel method for preventing blocked apertures caused by charged particles on an apertured mask means such as a shadow mask of a cathode-ray tube and more particularly to a method for manufacturing color picture tubes in which charged particles, which become attached to the beam intercepting interior surface of the shadow mask during the manufacturing process, are rendered conductive so as not to deflect the transmitting portions of the electron beams from the proper apertures in the shadow mask.

During the manufacturing and handling of a color television picture tube, both conductive and nonconductive particles may be trapped or generated within the tube. Typical rejection rates due to such particles average about one-half of one percent for new tubes and as high as five to ten percent for reworked tubes. Conductive particles include carbonized fibers, soot, aluminum flakes and weld splash. Nonconductive or insulative particles usually comprise glass, fiberglass and phosphor. Glass particles may be introduced into the tube during the reworking of tubes when the tubes are renecked, or the glass particles may be generated inside both new or reworked tubes, for example, from cracked stem fillets, or mechanical damage from the friction of the bulb spacer snubbers against the glass during gun insertion. Glass particles can also be generated by crazing of the neck glass and the glass support beads during high voltage processing or from electron bombardment of the glass.

Conductive particles cause picture imperfections such as dark spots on the screen if the particles physically block the apertures in the shadow mask. The spots or shadows from conductive particles blocking the shadow mask apertures will appear on the screen to be approximately the same size as the particles in the mask apertures.

On the other hand, insulative particles which are charged negatively by the electron beams will cause deflection of the beams by coulomb repulsion. Therefore, these particles can cause picture imperfections such as screen spots when attached to the mask without physically blocking the mask apertures. Furthermore, it has been observed that the insulative particles, in addition to causing screen spots, also cause color misregister of the electron beams. The color misregister creates a "halo" effect resulting from the electron beams being deflected and striking the phosphor elements surrounding the obscured region.

An apparatus for removing charged particles from a conductive element, such as a shadow mask of a color picture tube is described in U.S. Pat. No. 3,712,699 issued on Jan. 23, 1973 to Syster. The apparatus requires that the vacuum integrity of the tube be interrupted by removing the neck portion of the tube. As pointed out herein, the renecking or rework operation is a major cause of particle scrap so the apparatus disclosed in the Syster patent is only a partial solution to the problem. Furthermore, after the cleaning and rebuilding procedure disclosed in the Syster patent, the tube must be reprocessed. During reprocessing (exhaust, spot knocking, high voltage aging, etc.), additional particles may be generated.

Thus, a procedure is required by which the vacuum integrity of the tube is maintained, but the effect of the most troublesome particles, i.e., the nonconductive charged particles which become affixed to the beam intercepting interior surface of the shadow mask during the manufacturing process is eliminated.

SUMMARY OF THE INVENTION

A method of processing a cathode-ray tube is proposed. The cathode-ray tube comprises an evacuated envelope. Within the envelope is a luminescent viewing screen, means for producing at least one electron beam for exciting the screen to luminescence and an apertured mask closely spaced from said screen for selectively intercepting and transmitting portions of said electron beam. Gettering means are provided for coating an interior surface of the mask with a gas-sorbing, conductive getter material film. Further processing steps follow getter flashing. The improvement comprises controlling the getter flashing step so that the gettering means yields a primary film having about 50 to 75 percent of the available getter material. Preferably, the gettering means is reactivated subsequent to one of the further processing steps and before a final processing step to provide a secondary film of conductive getter material on the interior surface of the mask.

DESCRIPTION OF THE PREFERRED EMBODIMENT

Figure 1:
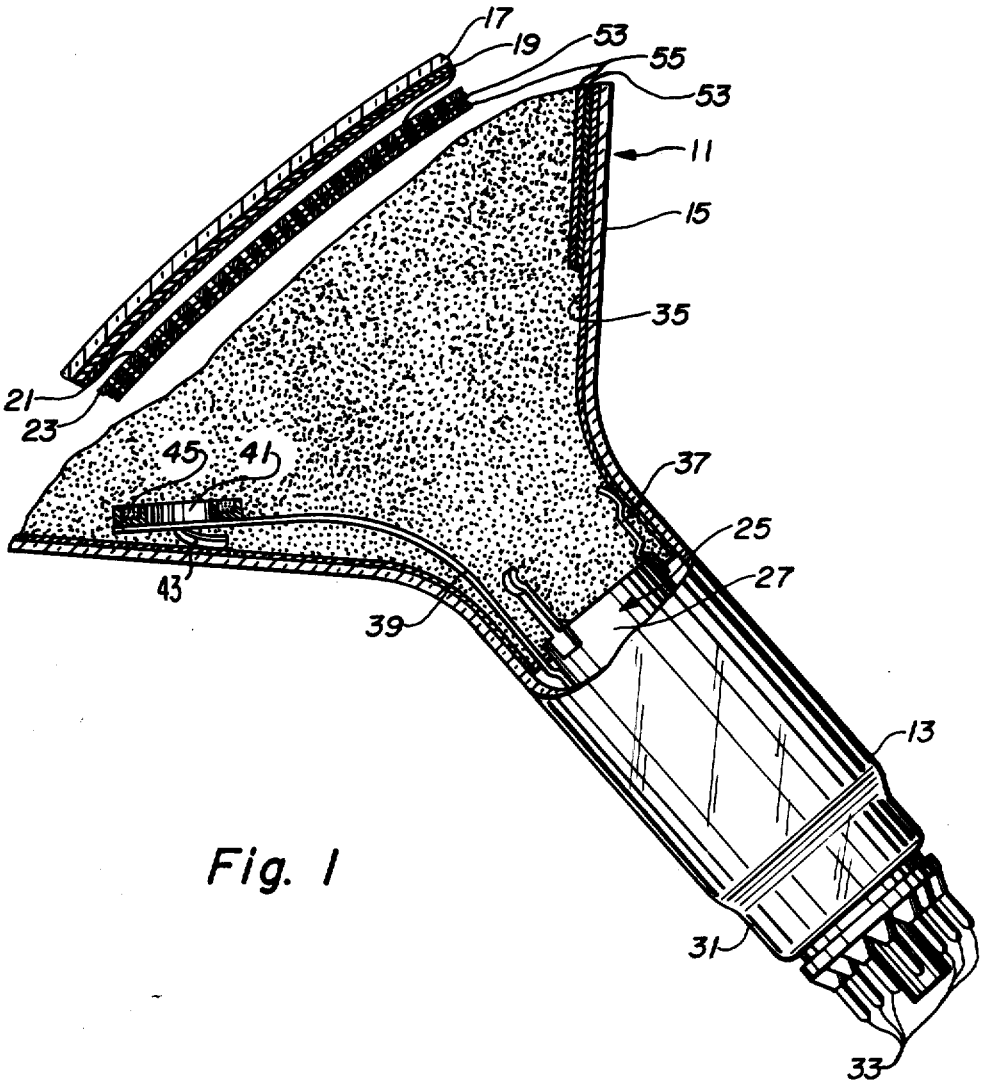
FIG. 1 is an enlarged, fragmentary, partially broken-away longitudinal view of a cathode-ray tube.

The cathode-ray tube illustrated in FIG. 1 is an apertured-mask-type color television picture tube. The tube comprises an evacuated envelope 11 including a cylindrical neck 13 extending from the small end of a funnel 15. The large end of the funnel 15 is closed by a faceplate panel 17. A luminescent tricolor mosaic screen 19, which is backed by a reflecting metal layer 21 of aluminum metal, is supported on the inner surface of the panel 17. The screen comprises a multiplicity of trios, each comprising a green-emitting, a red-emitting and a blue-emitting element. A shadow mask 23 is supported within the envelope close to the screen to achieve color selection. The mask is a metal sheet having an array of apertures therethrough which are systematically related to the trios of the screen 19. An electron gun mount assembly 25 comprising an array of three similar electron guns for generating three electron beams is mounted in the neck 13. The mount assembly includes a convergence cup 27, which is that element of the mount assembly closest to the screen 19. The end of the neck 13 is closed by a stem 31 having terminal pins or leads 33 on which the mount assembly 25 is supported and through which electrical connections are made to various elements of the mount assembly 25.

An opaque, conductive funnel coating 35 comprising graphite, iron oxide and a silicate binder on the inner surface of the funnel 15 is electrically connected to the high-voltage terminal or anode button (not shown) in the funnel 15. A plurality of bulb spacers 37 are welded to and connect the convergence cup 27 with the funnel coating 35. The bulb spacers 37, which are preferably made of spring steel, also center and position the extended end of the mount assembly 25 with the longitudinal axis of the tube.

A getter assembly comprises an elongated spring 39, which is attached at one end to the cup 27 of the mount assembly 25 and extends in cantilever fashion onto the funnel 15. A metal getter container 41 is attached to the other extended end of the spring 39, and a sled including two curved runners 43 is attached to the bottom of the container 41. The container has a ring-shaped channel containing getter material 45 with a closed base facing the inner wall of the funnel 15. The spring 39 is a ribbon of metal which urges the base of the container 41 outwardly toward the funnel wall with the runners 43 contacting the coating 35. The length of the spring 39 permits the container 41 to be positioned well within the funnel 15, where the getter material can be flashed (vaporized) to provide optimum coverage and where the spring 39 and container 41 will be out of the paths of the electron beams issuing from the mount assembly 25 and not interfere with the operation of the tube.

As shown in FIG. 1, the tube is assembled and the envelope has been evacuated of gases and hermetically sealed. This may be achieved by any of the known fabrication and assembly processes. In this embodiment, the getter container 41 holds a mixture of nickel and a barium-aluminum alloy, which upon heating reacts exothermically, vaporizes barium metal and leaves a residue of an aluminum-nickel alloy and barium metal in the container 41.

To "flash" the getter; that is, to cause the exothermic reaction to take place, use is made of an induction heating coil (not shown). The induction coil, by induction, will heat the getter container 41 and its contents 45 until the contents flash releasing barium vapor. The barium vapor deposits as a gas-sorbing barium metal layer 53, principally on the interior surface of the mask 23 and also on a portion of the funnel coating 35. In tubes with an internal magnetic shield (not shown), a portion of the shield also has a layer 53 of barium metal deposited thereon. The total amount of available barium metal contained in the above-described getter container 41 is about 265 milligrams (mgs); however, the exothermic reaction releases an average of about 180 mg of barium. To ensure a sufficient quantity of barium for gettering purposes, about 50 to 75 percent of the available 265 mgs of barium should be released during the getter flash. The total amount of barium released is controlled by varying the induction heating time after the exothermic reaction occurs. By increasing the heating time, more barium metal is released. The barium metal released after the initial flash is endothermically evolved from the container 41.

Figure 2:
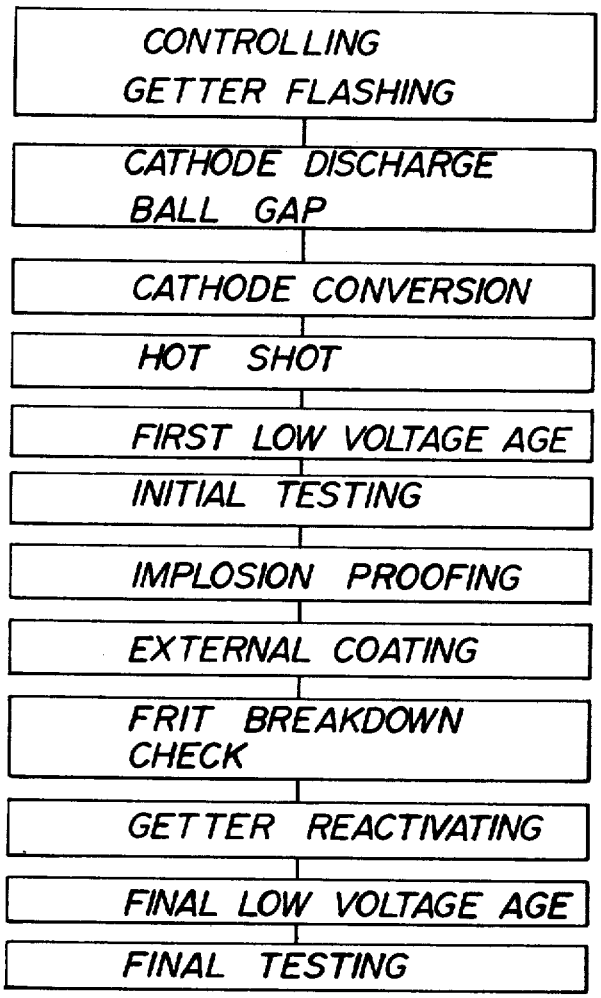
FIG. 2 is a process flow chart illustrating generally the steps, including the novel getter reactivation step, employed in processing finished cathode-ray tubes according to the invention.

During the subsequent tube processing and testing steps indicated generally in FIG. 2 and including cathode discharge ball gap (CDBG), cathode conversion, hot shot, first low voltage age, initial test, implosion proofing, external coating, frit breakdown check, radio frequency spot knock (RFSK), final low voltage age and final test, the tube is handled extensively and exposed to high voltages which may either mechanically or electrically transport particles to the shadow mask 23. While conductive particles can often be removed from the mask by externally-controlled means, such as mechanical vibration, heating the mask with an AC magnetic field and mechanically moving a free magnetic object on the inside of the mask controlled by an external magnet, such methods are of little use in dislodging insulative particles, such as glass. Glass particles may be strongly bound to the mask because of electrostatic charge interaction or anodic bonding between the insulating particles and the mask. Anodic bonding is assumed to be caused by interdiffusion of atoms at the interface between the glass and metal as a result of the applied electric field. Anodic bonding and the resulting glass-to-metal adhesion force can be affected by surface treatment of the components. Thus, the film of barium metal 53 covering the mask 23 after getter flash may contribute to the adhesion of the glass particles by providing a smooth, clean conductive metal surface which facilitates adhesion.

As discussed above in the background of the invention, the insulative particles adhering to the shadow mask 23 become negatively charged by the electron beams and deflect the transmitting portions of the electron beam from the proper mask aperture causing an apparent "blocked aperture" in the shadow mask and a resultant dark spot surrounded by a halo (hereinafter called a halo blocked aperture) to appear on the screen. Experiments have shown that tubes "salted" with glass particles exhibit literally hundreds of halo blocked apertures. Since it is impossible to remove the glass and other insulative particles from the tube without interrupting the vacuum integrity of the envelope, applicant has devised a novel processing procedure for rendering the insulative particles on the shadow mask conductive and thereby preventing the deflection of the transmitting portions of the electron beams by negatively-charged particles. While less than one percent of newly manufactured tubes exhibit halo blocked apertures, the procedure described hereinafter can economically be applied to all tubes during the manufacturing process.

The method of eliminating halo blocked apertures is to reactivate or "reflash" the getter on all tubes at the last "particle-generating" step in the manufacturing process. Since the getter container 41 has a barium metal residue remaining after the initial exothermic getter flash, the barium may be endothermically released from the container 41 and deposited as a secondary getter film 55 on the interior surface of the mask 23 and on a portion of the funnel coating 35 as well as on the charged particles on the mask 23 by inductively heating the container 41 for a period of time sufficient to evaporate additional barium metal. A small quantity of barium is sufficient to render the insulative particles adhering to film 53 on the mask 23 conductive. It has been determined that after the initial controlled getter flash, about 25 percent to 50 percent of the barium metal remains in the container for the reflashing step. While two stage exothermic getters are not presently available, this process would also lend itself to such a getter when and if such getters become available.

In the preferred method, the getter flash step occurs immediately after the radio frequency spot knock (RFSK) step and before the final low voltage age step; however, it is believed that the reflash may occur after the frit breakdown check and before the RFSK step without jeopardizing the tube yield. Regardless of where, in the processing sequence, the getter reflash step occurs, the getter container 41 is inductively heated, as described above, for a period of time ranging from 30 to 60 seconds. During this time barium metal is endothermically deposited as the secondary getter film 55 on the primary getter film 53 previously disposed on the interior surface of the mask 23 and on a portion of the funnel coating 35. The secondary getter film 55 is also deposited on any insulative particles attached to the getter film 53 on the interior surface of the shadow mask, thereby rendering such particles conductive. The secondary getter film 55 may comprise as much as 60 mg of barium. The total barium yield of the reflashed getter varies from tube to tube and depends on such factors as the coupling between the induction coil and the container 41, the amount of barium residue in the container available for getter reflash and the heating time during the reflashing step.

Although the preferred embodiment has been described with respect to a tube having a shadow mask type apertured mask, it should be understood that the novel method can also be used in tubes having different types of apertured masks such as focus masks or focus grills. It further should be understood that the various tube processing steps described herein may vary greatly and may include other steps not mentioned.

What is claimed is:

1. In a method of processing a cathode-ray tube comprising an evacuated envelope having therein a luminescent viewing screen, means for producing at least one electron beam for exciting said screen to luminescence, an apertured mask closely spaced from said screen and gettering means for depositing a gas-sorbing, conductive getter material film on an interior surface of said mask, the method including the step of getter flashing, followed by further processing steps, the improvement comprising controlling said getter flashing step so that said getter means yields a primary film sufficient for gettering purposes and utilizing less than all of the available getter material, and reactivating said getter means subsequent to at least one of said further processing steps and before a final processing step to provide a secondary film of conductive getter material on said interior surface of said mask.

2. The method of claim 1 wherein said primary film sufficient for gettering purposes utilizes about 50 to 75 percent of the available getter material.

3. In a method of processing a cathode-ray tube comprising an evacuated envelope having therein a luminescent viewing screen, means for producing at least one electron beam for exciting said screen to luminescence, an apertured mask closely spaced from said screen and gettering means for depositing a gas-sorbing, conductive getter material film on an interior surface of said mask, the method including the steps of getter flashing, frit breakdwon check, radio frequency spot knock and final low voltage age, the improvement comprising controlling said getter flashing step so that said getter means yields a primary film sufficient fo gettering purposes utilizing less than all of the available getter material, and reactivating said getter means subsequent to said frit breakdown check step and before said final low voltage aging step to provide a secondary film of conductive getter material on said interior surface of said mask.

4. The method of claim 3 wherein said primary film sufficient for gettering purposes utilizes about 50 to 75 percent of the avilable getter material.

5. The tube as in claim 1 or 3 wherein said reactivating step includes inductively heating said getter means for a period of time ranging from 30 to 60 seconds during which time an endothermic getter reaction occurs.

6. The tube as in claim 3 wherein said reactivating step occurs after said radio frequency spot knock step.

7. In a method of processing a completed cathode-ray tube including the steps of getter flashing, cathode discharge ball gap, cathode conversion, hot shot, first low voltage age, implosion proofing, external coating, frit breakdown check, radio frequency spot knock, and final low voltage age, said tube having an evacuated envelope with a conductive coating on an interior portion thereof, a luminescent viewing screen within said envelope, means for producing at least one electron beam for exciting said screen to luminescence, an apertured mask closely spaced from said screen and gettering means for depositing a gas-sorbing, conductive getter material on an interior surface of said mask, and on said interior conductive coating of said envelope, the improvement comprising:

inductively heating said gettering means until an exothermic getter flash occurs, then terminating said inductive heating so that said gettering means yields a primary film having about 50 to 75 percent of the available getter material, and reactivating said getter means after said radio frequency spot knock so as to provide a secondary film of conductive getter material on said interior surface of said mask and on said interior conductive coating of said envelope.

* * * * *